US005376754A

United States Patent [19]

Stich

[11] Patent Number: 5,376,754

[45] Date of Patent: Dec. 27, 1994

[54] PICKUP APPARATUS, HAVING A WINDING WITH AN ADJACENT CLOSED CIRCUIT, FOR STRINGED MUSICAL INSTRUMENTS

[75] Inventor: Willi L. Stich, Mt. Juliet, Tenn.

[73] Assignee: Gibson Guitar Corp., Nashville, Tenn.

[21] Appl. No.: 3,457

[22] Filed: Jan. 12, 1993

[51] Int. Cl.[5] ..... G10H 3/18

[52] U.S. Cl. ..... 84/728

[58] Field of Search ..... 84/726–728

[56] References Cited

U.S. PATENT DOCUMENTS

| | | | |
|---|---|---|---|
| Re. 20,070 | 8/1936 | Lesti . | |
| 2,119,584 | 6/1938 | Knoblauch . | |
| 2,262,335 | 11/1941 | Russell . | |
| 2,896,491 | 7/1959 | Lover . | |
| 3,711,619 | 1/1973 | Jones et al. . | |
| 3,915,048 | 10/1975 | Stich . | |
| 3,916,751 | 11/1975 | Stich . | |
| 4,143,575 | 3/1979 | Oliver | 84/726 |
| 4,151,776 | 5/1979 | Stich . | |
| 4,164,163 | 8/1979 | Rhodes . | |
| 4,222,301 | 9/1980 | Valdez | 84/728 |
| 4,364,295 | 12/1982 | Stich . | |
| 4,442,749 | 4/1984 | DiMarzio et al. . | |
| 4,501,185 | 2/1985 | Blucher . | |
| 4,809,578 | 3/1989 | Lace, Jr. . | |

OTHER PUBLICATIONS

*The Guitar Handbook*, Ralph Denyer with Isaac Guillory and Alastair M. Crawford, pp. 52–53, 186–189 and 194 (1982).

"Pickups The 10 Most Frequently Asked Questions Answered by Bill Lawrence", *Guitar Player* magazine, Dec. 1975.

*Primary Examiner*—Stanley J. Witkowski

*Attorney, Agent, or Firm*—Dougherty, Hessin, Beavers & Gilbert

[57] ABSTRACT

A pickup apparatus for a stringed musical instrument includes an electromagnetic string vibration sensor, preferably including at least one winding, and a feature associated therewith, preferably a conductive closed circuit around the winding, to suppress resonant peaks and thereby equalize the harmonic reproduction. The apparatus preferably includes two such windings and circuits connected in a hum-canceling manner. A second hum-canceling pair of windings having a lower inductance to reproduce clean highs without phase cancellation can be added along with a resistive-capacitive network so that the combination can reproduce a wide variety of different sounds, all at a consistent high output level.

30 Claims, 1 Drawing Sheet

PICKUP APPARATUS, HAVING A WINDING WITH AN ADJACENT CLOSED CIRCUIT, FOR STRINGED MUSICAL INSTRUMENTS

BACKGROUND OF THE INVENTION

This invention relates to electromagnetic pickup apparatus for stringed musical instruments. The following explanation is made with specific, but non-limiting, reference to electric guitars.

There are many different sounding electromagnetic pickup devices. Any one type typically tends to reproduce only a powerful low end with lesser highs or a brilliant high end with a lack of lows and a considerable loss of output. One type of pickup apparatus particularly suited for reproducing the low end has a hum-canceling dual-winding transducer, whereas one type of pickup apparatus particularly suited for reproducing the high end has a non-hum-canceling single-winding transducer. Although combinations of these are used to give a player a wider variety of sounds at different output levels, there are at least two shortcomings of relevance to the present invention: resonant peaks and location of pickups.

As to resonant peaks, a prior hum-canceling dual-winding pickup apparatus typically has wide band peaks in the midrange (e.g., 3,000 hertz to 5,000 hertz) that can make the reproduced sound undesirably harsh because at least some of these peaks correspond to, and thus enhance the reproduction of, undesired harmonics of a low fundamental frequency produced by a vibrating string when it is played.

As to the location factor, such a prior hum-canceling dual-winding pickup device located at the fingerboard position tends to reproduce imprecise and mushy low frequencies, especially at today's high volume performance levels. Such lows are better reproduced by the pickup at the bridge position; however, this is where the aforementioned harmonics are more likely sensed and reproduced.

The location of the pickup apparatus can also hinder the player in his or her performance when several transducers have to be mounted between the bridge and fingerboard to give the player a variety of different sounds. These can physically impede playing both because they can be in the way when the player wants to pick individual strings and because they require the player to reach for and manipulate multiple controls for connecting different combinations of the transducers.

In view of the aforementioned shortcomings, there is the need for a pickup apparatus that can reproduce a rich powerful low end without significant harshness due to harmonics in the midrange where resonant peaks have typically existed in previous pickup apparatus. Such a pickup apparatus should also be substantially noise free. Preferably, such a pickup apparatus should also be able to sense and reproduce brilliant highs. To free the playing area and obviate excessive control handling, thereby facilitating playing, such a pickup apparatus preferably should have a single transducer assembly that can be located out of the player's way near the bridge of the instrument and that can be used in reproducing a variety of sounds heretofore available only through the use of multiple transducer assemblies, and such reproduction should be at a consistent high output level regardless of whether lows or highs are being reproduced.

SUMMARY OF THE INVENTION

The present invention overcomes the above-noted and other shortcomings of the prior art and meets the aforementioned needs by providing a novel and improved pickup apparatus for a stringed musical instrument. Advantages include substantially noise free reproduction of rich powerful lows without significant distortion by harmonics in the midrange. In at least a preferred embodiment, further advantages include: reproduction of the high end along with the low end; compact construction for preferred location solely adjacent the bridge; reproduction of a variety of sounds without multiple transducer assemblies; and consistent high output levels.

The present invention provides a pickup apparatus for a stringed musical instrument, comprising: an electrically conductive winding for mounting on the instrument and for connecting into an amplification circuit; and an electrically conductive closed circuit disposed adjacent the winding.

In a more particular embodiment, the present invention provides a pickup apparatus for a stringed musical instrument, comprising: first hum-canceling electromagnetic means for responding to string vibrations, including first and second windings connected in series; a first overwinding adjacent the first winding; a second overwinding adjacent the second winding; second hum-canceling electromagnetic means for responding to string vibrations, including third and fourth windings connected in series, the second hum-canceling electromagnetic means connected in series with the first hum-canceling electromagnetic means; and a series resistive-capacitive network connected in series with the second hum-canceling electromagnetic means and in parallel with the first hum-canceling electromagnetic means.

Therefore, from the foregoing, it is a general object of the present invention to provide a novel and improved pickup apparatus for stringed musical instruments. Other and further objects, features and advantages of the present invention will be readily apparent to those skilled in the art when the following description of the preferred embodiment is read in conjunction with the accompanying drawings.

DETAILED DESCRIPTION OF PREFERRED EMBODIMENT

Figure 1:
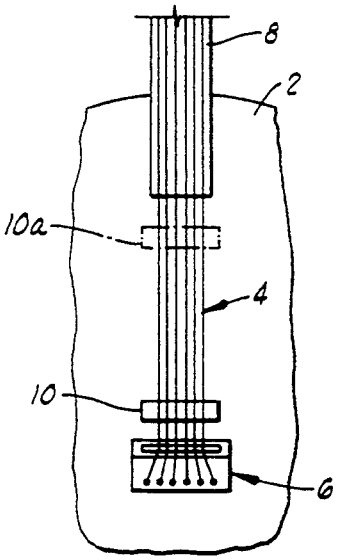
FIG. 1 is a representation of a part of an electric guitar with which the present invention can be used.

Although the present invention can be used with any stringed musical instrument, the preferred embodiment is particularly adapted for use with an electric guitar 2 partially represented in FIG. 1. The illustrated guitar 2 has six strings 4, but more or less may be used on other types of guitars or other musical instruments. The strings 4 are anchored at their lower ends in conventional manner near a bridge 6, and they are connected at their upper ends to tuning screws (not shown) located at the upper end of fingerboard 8.

Mounted in conventional manner beneath the strings 4 adjacent the bridge 6 is a pickup apparatus 10 of the present invention. Although this is the preferred mounting location, at least a portion 10*a* of one embodiment of the pickup apparatus can be mounted on the body of the guitar 2 at other locations (e.g., near the end of the fingerboard 8) spaced from the primary portion that preferably remains near the bridge 6.

Figure 2:
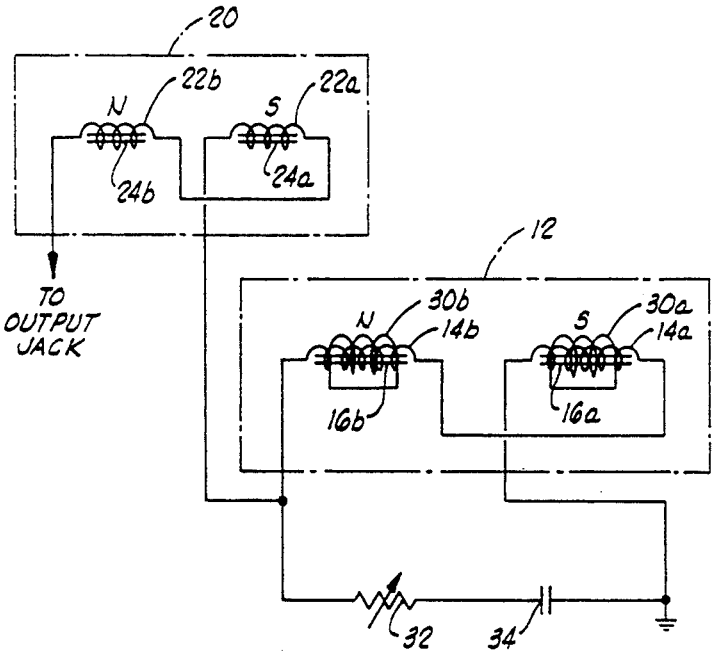
FIG. 2 is a schematic circuit diagram of the preferred embodiment pickup apparatus of the present invention.

Referring to FIG. 2, the pickup apparatus 10 of the preferred embodiment includes electromagnetic transducer means 12 for providing a magnetic field and for conducting an electrical current in response to vibration of one or more of the strings 4 in the magnetic field when the electromagnetic means 12 is connected into a conventional amplification circuit (not shown). The electrical current has frequency responsive to vibration of the strings 4 in the magnetic field. This occurs in a manner as known in the art.

In the preferred embodiment, the electromagnetic means 12 is particularly adapted for connecting adjacent the bridge 6 to be out of the player's way and because the full harmonic spectrum can be sensed only at the bridge.

Figure 3:
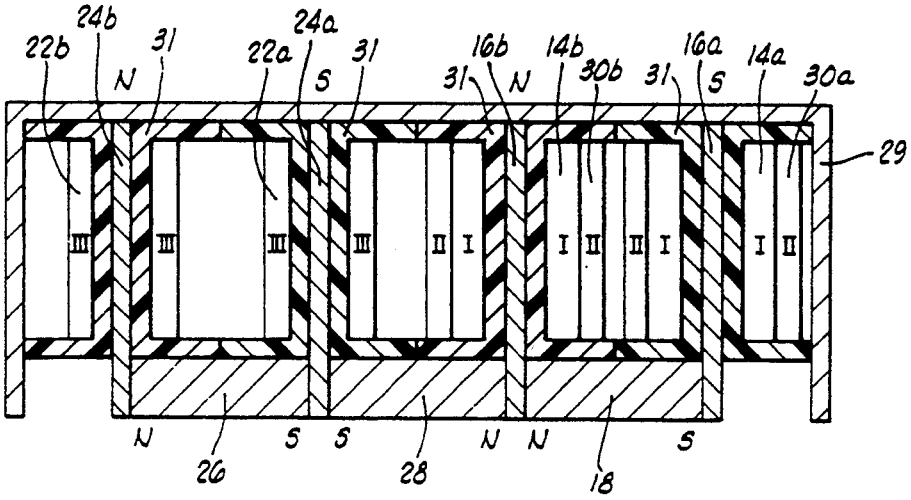
FIG. 3 is a schematic sectional view of a particular implementation of the winding structure of the apparatus represented in FIG. 2.

The electromagnetic means 12 of the preferred embodiment includes at least one electrically conductive winding 14 and at least one associated pole piece 16. More preferably, there are two such windings 14*a*, 14*b* connected in series and mounted on respective pole pieces 16*a*, 16*b*; and most preferably, the two windings of this pair are connected in a known hum-canceling relationship (e.g., either a standard Gibson side-by-side humbucker configuration or a standard Gibson stacked configuration known in the art). As shown in FIG. 3, the pole pieces 16*a*, 16*b* can be magnetized at least in part by an adjacent permanent magnet 18.

Although the electromagnetic means 12, modified as subsequently described and claimed, has utility by itself, the pickup apparatus 10 more preferably further comprises another electromagnetic transducer means for providing another magnetic field and for conducting electrical current in response to vibration of one or more of the strings 4 in this other magnetic field. This is generally identified in FIG. 2 by reference numeral 20.

The electromagnetic means 20 preferably includes a pair of electrically conductive windings 22*a*, 22*b* wound around respective pole pieces 24*a*, 24*b* magnetized by permanent magnet 26 (FIG. 3). Further magnetization of both electromagnetic means 12, 20 is provided by a permanent magnet 28 disposed between pole pieces 16*b*, 24*a* in the FIG. 3 configuration, wherein windings 14*b*, 22*a* are in higher magnetic flux than windings 14*a*, 22*b*.

To provide a complete, out-of-the-way winding package, the two pairs of windings 14*a*, 14*b* and 22*a*, 22*b* are preferably disposed adjacent each other and mounted in a single housing 29 (FIG. 3) of conventional size and shape (e.g., preferably less than 1.5 inches wide so that it is interchangeable with a standard prior type of pickup). This package is preferably mounted adjacent the bridge 6 where the present invention is responsive to both low and high frequencies of the played strings and is out of the way when the player plays the strings. It is contemplated by the present invention, however, that the electromagnetic means 20 can be assembled in a separate housing from the electromagnetic means 12 and mounted elsewhere on the guitar 2, such as described above as portion 10*a* shown in FIG. 1.

Referring to FIG. 3, there is shown a particular implementation of the preferred embodiment of FIG. 2 described thus far. This implementation is a lateral side-by-side configuration rather than a vertical, stacked configuration which can also be used (or a combination of side-by-side and stacked can be used). The windings are wound in a conventional manner around respective elongated, centrally slotted coil forms 31 having lateral cross-sectional "I" shapes as shown in FIG. 3. The windings 14*a*, 14*b* are disposed in regions I around their respective coil forms, and the windings 22*a*, 22*b* are disposed in regions III around their respective coil forms. The materials of construction are conventional. By way of non-limiting example only, the windings may be made of 44 or 46 gauge wire with the windings 14*a*, 14*b* having 6500 turns and the windings 20*a*, 20*b* having 2200 turns.

Used alone, the electromagnetic means 12 has resonant peaks within the midrange frequency response (e.g., 3,000 hertz to 5,000 hertz). This causes harmonics of like frequency contained within the vibrations of the strings 4 to be significantly reproduced. As previously mentioned, this can produce an undesired sound.

To prevent this undesired harsh reinforced reproduction in the present invention, the pickup apparatus 10 further comprises means for suppressing in the amplified sound the generation of harmonics within a predetermined range, preferably from about 3,000 hertz to about 5,000 hertz with respect to an electric guitar. In the preferred embodiment, this preferably mid-range harmonic suppressing means decreases the effective inductance of the electromagnetic means 12 in response to increasing frequencies. In a specific (but non-limiting) implementation for an electric guitar, this decrease is from, for example, a nominal inductance of about 10 henries at lower frequencies to about 5 henries in the preferred midrange, as compared with a substantially constant inductance of preferably less than about 1.6 henries and more preferably less than about 1.0 henry for a corresponding electromagnetic means 20 (the ratio between nominal inductances of the electromagnetic means 20 and the electromagnetic means 12 is preferably at least 1:4). This decreased inductance of the modified electromagnetic means 12 suppresses harmonic reproduction without significantly affecting the output signal level.

Referring to FIG. 2, the harmonic suppressing means of the preferred embodiment includes an electrically conductive closed circuit 30*a* inductively coupled to the winding 14*a* and an electrically conductive closed circuit 30*b* inductively coupled to the winding 14*b*. Referring to FIG. 3, each closed circuit is defined by a respective wire overwinding in the two respective regions II; however, it is contemplated that each closed circuit can be located elsewhere relative to its primary winding (e.g., inwardly of or in the middle of the primary winding). Preferably an insulating layer, such as paper, is disposed between the windings in region I and the closed circuit winding in region II. Each of these closed circuits can be simply a respective loop of wire having its ends connected together after being wound over the respective primary vibration sensing winding as schematically shown in FIG. 2, or they can include other components such as a variable or fixed resistor or capacitor or both by which the impedance of the closed circuit can be controlled. Such loops can include one or more turns (e.g., a single turn of #10 AWG insulated copper wire or a thousand turns of #44 AWG insulated copper wire). To obtain the highest precision in tuning the circuit, which is preferred in a hum-canceling pickup apparatus, a loop having more turns with a smaller wire is preferred. Such "closed circuit" as referred to herein means a self-contained current conductive circuit that is inductively coupled as described, but that is not electrically connected in the primary amplification circuit in which the windings 14*a*, 14*b*, 22*a*, 22*b* are intended to be connected.

Another feature of the overall preferred embodiment pickup apparatus 10 represented in FIG. 2 is a series resistive-capacitive network containing a variable resistor 32, such as a potentiometer, and a capacitor 34, which may also be a variable device or an array of two or more switch-selectable discrete capacitors, for example. A variable or fixed resistor can also be used in parallel with the capacitor(s). Control or selection is via control knobs or switches (not shown) accessible on the face of the guitar 2 in known manner. The values of these components can be of any suitable values as known in the art for tone control circuits. By way of specific but non-limiting examples, the capacitor 34 can be in the range of about 0.002 microfarad to about 0.05 microfarad.

In use on an electric guitar, one end of the pair of series-connected windings 22*a*, 22*b* (specifically, an end of winding 22*b* in FIG. 2) is connected to an output jack (not shown) into which a cord from an amplification circuit can be connected in known manner. The connection of the winding end to the output jack is preferably through a variable resistor operable from the front of the guitar to control volume in known manner. The other end of the pair of windings 22*a*, 22*b* is connected in series with the series-connected windings 14*a*, 14*b* and the resistive-capacitive network (namely, an end of winding 22*a*, an end of winding 14*b* and an end of resistor 32 in FIG. 2), which network is connected in parallel with the windings 14*a*, 14*b*. The common ends of the pair of windings 14*a*, 14*b* and the resistive-capacitive network not connected to the junction with the windings 22*a*, 22*b* (namely, the connected ends of winding 14*a* and capacitor 34 in FIG. 2) are connected to electrical ground in use. In this embodiment, full low end frequency reproduction is obtained because the lows are reproduced by both electromagnetic means 12, 20, which provides in combination a relatively wide magnetic field, while high end frequency reproduction is obtained by the electromagnetic means 20, which alone provides a narrower magnetic field. The resistor-capacitor network controls the cut-off for the electromagnetic means 12 and the highs passed by the electromagnetic means 20. The closed circuits 30*a*, 30*b* change the effective inductances of the windings 14*a*, 14*b*, respectively, so that undesired harmonics from the strings are suppressed in the amplified output sound. The foregoing can be obtained while still providing an overall impedance at 1,000 hertz within the range between 40 kilo-ohms and 80 kilo-ohms as needed for today's conventional amplification circuits.

Although the embodiment of FIG. 2 and the implementation of FIG. 3 are presently preferred, it is contemplated that other configurations can be used. For example, additional windings can be added in series with resistive-capacitive networks connected in parallel from electrical ground across one or more sets of windings; windings can be connected in parallel; multiple configurations can be obtained using switches; and, as previously mentioned, the resistive-capacitive network(s) can take various configurations of either fixed or variable nature.

In summary, the preferred embodiment of the present invention provides a pickup apparatus that can reproduce a wide variety of different sounds, all at a consistent high output level while also maintaining full hum-canceling effect. Each of the two windings of the higher inductance pair is surrounded with a loop of conductive material to decrease the inductance at the midrange frequencies and to suppress resonant peaks and corresponding harmonics, thereby allowing for the reproduction of a solid low end without harmonic harshness. The other hum-canceling pair of windings reproduces clean highs without the disadvantage of phase cancellation.

It is contemplated that through the use of a single one of the preferred embodiment unitary pickup apparatus, sounds replicating those of either the Gibson Les Paul guitar or the Fender Stratocaster guitar, for example, can be obtained. In this preferred embodiment, lows, highs and peaks are controllable with a single potentiometer (i.e., resistor 32) and the apparatus can be located on the instrument out of the way of the player (i.e., adjacent the bridge 6).

Thus, the present invention is well adapted to carry out the objects and attain the ends and advantages mentioned above as well as those inherent therein. While a preferred embodiment of the invention has been described for the purpose of this disclosure, changes in the construction and arrangement of parts and the performance of steps can be made by those skilled in the art, which changes are encompassed within the spirit of this invention as defined by the appended claims.

What is claimed is:

1. Pickup apparatus for a stringed musical instrument, comprising:

an electrically conductive winding for mounting on the instrument and for connecting into an amplification circuit; and an electrically conductive closed circuit disposed adjacent said winding but permanently electrically unconnected from said winding, the amplification circuit and the strings of the instrument.

2. Pickup apparatus as defined in claim 1, wherein said electrically conductive closed circuit consists of a closed loop of wire.

3. Pickup apparatus as defined in claim 1, further comprising:

an electrically conductive second winding, connected to the first-mentioned said winding; and an electrically conductive second closed circuit, disposed adjacent said second winding.

4. Pickup apparatus as defined in claim 3, wherein said first-mentioned winding and said second winding are connected in hum-canceling relationship.

5. Pickup apparatus as defined in claim 4, further comprising a resistive-capacitive network connected in parallel with said hum-canceling connected windings.

6. Pickup apparatus as defined in claim 3, wherein:

said first-mentioned winding and said second winding define a first pair of windings;

said pickup apparatus further comprises third and fourth electrically conductive windings defining a second pair of windings; and means for connecting said first and second pairs of windings.

7. Pickup apparatus as defined in claim 6, further comprising a resistive-capacitive network connected to said first and second pairs of windings.

8. Pickup apparatus as defined in claim 6, wherein said first and second pairs of windings are disposed adjacent each other.

9. Pickup apparatus as defined in claim 6, wherein said first-mentioned winding and said second winding are connected in hum-canceling relationship and further wherein said third winding and fourth winding are connected in hum-canceling relationship.

10. Pickup apparatus as defined in claim 1, wherein said closed circuit includes wire wound adjacent said winding.

11. Pickup apparatus as defined in claim 10, wherein said closed circuit consists of said wire and at least one other passive component.

12. Pickup apparatus as defined in claim 11, wherein said at least one other passive component is selected from the group consisting of resistors and capacitors.

13. Pickup apparatus for a stringed musical instrument, comprising:

electromagnetic means, having a nominal inductance, for providing a magnetic field and for enabling electrical current to be conducted with frequency responsive to vibration of at least one string of the instrument in the magnetic field; and closed loop electrically conductive mid-range harmonic suppressing means, coupled to said electromagnetic means, for conducting electrical current in said electrically conductive means so that the inductance of said electromagnetic means is reduced in response to frequency throughout a range of frequencies.

14. Pickup apparatus as defined in claim 13, further comprising second electromagnetic means, having a nominal inductance lower than said first-mentioned electromagnetic means, for providing another magnetic field and for enabling electrical current to be conducted with frequency responsive to vibration of at least one string of the instrument in said another magnetic field, said second electromagnetic means having a first end adapted for connecting to an amplification circuit and having a second end connected to said first-mentioned electromagnetic means.

15. Pickup apparatus as defined in claim 14, further comprising a series resistive-capacitive network connected to said second end of said second electromagnetic means.

16. Pickup apparatus as defined in claim 15, wherein said first-mentioned electromagnetic means includes a first hum-canceling pair of electrically conductive windings and said second electromagnetic means includes a second hum-canceling pair of electrically conductive windings.

17. Pickup apparatus as defined in claim 16, wherein said first and second hum-canceling pairs of windings are mounted adjacent each other.

18. Pickup apparatus as defined in claim 16, wherein said suppressing means includes a first electrically conductive loop around one of the windings of said first pair and a second electrically conductive loop around the other of the windings of said first pair.

19. Pickup apparatus as defined in claim 18, wherein said range of frequencies includes about 3,000 hertz to about 5,000 hertz.

20. Pickup apparatus as defined in claim 13, wherein said electromagnetic means includes a pair of electrically conductive windings connected in series and wherein said suppressing means includes a first electrically conductive loop around one of said windings and a second electrically conductive loop around the other of said windings, and further wherein said range of frequencies includes about 3,000 hertz to about 5,000 hertz.

21. Pickup apparatus as defined in claim 13, wherein said suppressing means includes wire wound adjacent said electromagnetic means.

22. Pickup apparatus as defined in claim 21, wherein said suppressing means consists of said wire and at least one other passive component.

23. Pickup apparatus as defined in claim 22, wherein said at least one other passive component is selected from the group consisting of resistors and capacitors.

24. Pickup apparatus as defined in claim 20, wherein each of said first and second electrically conductive loops consists of a respective closed loop of wire wound adjacent the respective one of said windings.

25. Pickup apparatus as defined in claim 20, wherein each of said first and second electrically conductive loops consists of respective wire and at least one other respective passive component.

26. Pickup apparatus for a stringed musical instrument, comprising:

first hum-canceling electromagnetic means for responding to string vibrations, including first and second windings connected in series;

a first overwinding adjacent said first winding;

a second overwinding adjacent said second winding;

second hum-canceling electromagnetic means for responding to string vibrations, including third and fourth windings connected in series, said second hum-canceling electromagnetic means connected in series with said first hum-canceling electromagnetic means; and a series resistive-capacitive network connected in series with said second hum-canceling electromagnetic means and in parallel with said first hum-canceling electromagnetic means.

27. Pickup apparatus as defined in claim 26, further comprising a housing having at least said first and second hum-canceling electromagnetic means and said first and second overwindings disposed therein.

28. Pickup apparatus as defined in claim 26, wherein:

said first winding and said resistive-capacitive network have ends connected in common and adapted for connecting to an electrical ground;

said first winding has another end, connected to an end of said second winding;

said second winding has another end, connected in common with another end of said resistive-capacitive network and an end of said third winding;

said third winding has another end, connected to an end of said fourth winding; and said fourth winding has another end, adapted for connecting to an amplification circuit.

29. Pickup apparatus as defined in claim 26, wherein:

said first overwinding includes a first wire, wound adjacent said first winding; and said second overwinding includes a second wire, wound adjacent said second winding.

30. Pickup apparatus as defined in claim 29, wherein:

said first overwinding consists of said first wire and at least one other passive component; and said second overwinding consists of said second wire and at least one other passive component.

* * * * *